US006944270B1

(12) United States Patent
Kim

(10) Patent No.: US 6,944,270 B1
(45) Date of Patent: Sep. 13, 2005

(54) X-RAY SOURCE

(75) Inventor: Bonglea Kim, Troy, MI (US)

(73) Assignee: Osmic, Inc., Auburn Hills, MI (US)

( * ) Notice: Subject to any disclaimer, the term of this patent is extended or adjusted under 35 U.S.C. 154(b) by 0 days.

(21) Appl. No.: 10/787,264

(22) Filed: Feb. 26, 2004

(51) Int. Cl.[7] ..... H01I 35/14
(52) U.S. Cl. ..... 378/125; 378/126
(58) Field of Search ..... 378/125, 126, 378/143, 137, 138, 119, 135, 123, 122, 121

(56) References Cited

U.S. PATENT DOCUMENTS

| | | | | |
|---|---|---|---|---|
| 2,133,606 A | | 10/1938 | Du Mond | |
| 3,602,686 A | * | 8/1971 | Lempert | 219/121.14 |
| 3,689,790 A | * | 9/1972 | Haas et al. | 378/126 |
| 3,737,698 A | * | 6/1973 | Carter | 378/124 |
| 3,753,020 A | * | 8/1973 | Zingaro | 378/141 |
| 3,794,872 A | | 2/1974 | Hass et al. | |
| 4,104,531 A | * | 8/1978 | Weiss | 378/38 |
| 4,800,581 A | | 1/1989 | Kujirai et al. | |
| 4,878,235 A | | 10/1989 | Anderson | |
| 5,128,977 A | | 7/1992 | Danos | |
| 5,210,781 A | | 5/1993 | Ono et al. | |
| 5,222,114 A | | 6/1993 | Kamata et al. | |
| 5,581,591 A | | 12/1996 | Burke et al. | |
| 5,588,035 A | | 12/1996 | Christean et al. | |
| 5,689,542 A | * | 11/1997 | Lavering et al. | 378/141 |
| 6,185,277 B1 | | 2/2001 | Harding | |
| 6,333,967 B1 | | 12/2001 | Osaka et al. | |

FOREIGN PATENT DOCUMENTS

| | | |
|---|---|---|
| DE | 29622655 U1 | 3/1997 |
| JP | 406269439 A | 9/1994 |
| JP | 2004055325 | 2/2004 |

* cited by examiner

*Primary Examiner*—Edward J. Glick
*Assistant Examiner*—Hoon Song
(74) *Attorney, Agent, or Firm*—Brinks Hofer Gilson & Lione

(57) ABSTRACT

The present invention provides an x-ray source including an electron-generation chamber with an electron beam source that emits electrons and a target chamber with a support structure and a target positioned within the support structure. The emitted electrons travel in a direction substantially parallel to a longitudinal axis extending between the electron-generation chamber and the target chamber towards the target and bombard the target to generate x-rays. The target is movable, while being bombarded with electrons, with respect to the support structure in at least one direction perpendicular to a longitudinal axis.

16 Claims, 3 Drawing Sheets

X-RAY SOURCE

BACKGROUND

The present invention relates generally to the field of x-ray generation, and more particularly to the field of sealed x-ray tubes.

In conventional x-ray sources, such as those employed in laboratory applications, x-rays are produced by the acceleration of electrons from a cathode to a target. The resulting interaction between the electrons and the target causes the emission of x-rays. Different target material produce different spectra of x-rays.

Often, electron beams are focused near or on the targets to obtain the dimensions of the x-ray source. Unfortunately, the constant bombardment of the target with accelerated electrons results in target damage, in particular, melting and evaporation of the target material. This degradation limits the performance and operating lifetime of the x-ray source.

To address the target degradation problem, some systems employ a rotating anode source, which rotates the target at high speeds to distribute the region subject to bombardment across a larger area. However, rotating anode sources are complicated in design and are expensive to maintain. Moreover, the brilliance of rotating anode sources are not as high as the brilliance of a single-spot micro-focusing source.

Other x-ray sources have attempted to steer the electron beam to different target areas using magnetic fields. This approach, however, presents a number of disadvantages. For example, by changing the position of the electron beam relative to the target center, the x-ray source position is altered which may require reconfiguration of the optical components. Also, these systems depend heavily on the electronic components responsible for controlling the magnetic fields, which unnecessarily complicates the circuitry and maintenance of the x-ray source. Moreover, circuit stability directly influences the source position stability.

For certain laboratory applications, it is imperative that the x-rays generated by the source are emitted from the same position relative to the optical components located outside the source. If the position of the source of x-rays is constantly changing, then the optical configuration of the experimental system must also be constantly changing to compensate for changes in the source position, which is highly inefficient.

Given the foregoing, it is evident that there is a need for a single-spot micro-focusing x-ray source that has the advantages of long-life and durability associated with a rotating anode, but with the high-brilliance needed for advanced x-ray applications.

BRIEF SUMMARY

In overcoming the above mentioned and other drawbacks, the present invention provides an x-ray source including an electron-generation chamber with an electron beam source that emits electrons and a target chamber with a support structure and a target positioned within the support structure. The target is movable, even during the emission of x-rays, with respect to the support structure in at least one direction substantially perpendicular to a longitudinal axis extending between the electron-generation chamber and the target chamber. The emitted electrons travel in a direction substantially parallel to the longitudinal axis towards the target and bombard the target to generate x-rays. A flexible sealing member couples the electron-generation chamber to the target chamber. The two chambers are typically vacuum sealed.

The x-ray source may include at least one target locator coupled to the target and adapted to move the target in at least a first direction substantially perpendicular to the longitudinal axis. In particular embodiments, the x-ray source includes a second target locator coupled to the target and adapted to move the target in a second direction substantially perpendicular to the longitudinal axis. The target may define a substantially planar surface that is tilted at an angle such that the planar surface is not orthogonal to the longitudinal axis. The second target locator may be adapted to move the target in a second direction substantially parallel to the planar surface.

In various embodiments, the target defines a planar surface normal to the longitudinal axis. In other embodiments, the planar surface is tilted at an angle such that the planar surface is not perpendicular to the longitudinal axis. The target may be secured to the support structure with an elastic member and it may be movable with respect thereto in at least one direction perpendicular to the longitudinal axis. In certain embodiments, x-rays transmitted from the target may pass through one or more exit apertures.

As described herein, the present invention provides numerous benefits over prior x-ray source designs. In particular, the present invention includes at least one mechanical or electromechanical target locator adapted to move the target relative to the impinging x-ray beam. The simplicity and consistency associated with moving the target increases the longevity of the target, and therefore the useful lifetime of the x-ray tube. Moreover, by maintaining the x-ray origin in a fixed location relative to the external optics, the present invention is readily adaptable for repeated and efficient use in a laboratory setting.

Further features and advantages of the present invention will become apparent from the detailed description and from the claims.

BRIEF DESCRIPTION OF THE DRAWINGS

The accompanying drawings, incorporated in and forming a part of the specification, illustrate several aspects of the present invention and, together with the description, serve to explain the principles of the invention. The components in the figures are not necessarily to scale, emphasis instead being placed upon illustrating the principles of the invention. Moreover, in the figures, like reference numerals designate corresponding parts throughout the views. In the drawings.

DETAILED DESCRIPTION

In accordance the present invention, an x-ray source 10 including an electron-generation chamber 12, a target chamber 14, and a movable target 30 is described herein with reference to the attendant Figures. In some of these figures, a set of Cartesian axes is included for descriptive purposes, where the z-axis is aligned substantially parallel to the longitudinal axis that extends, for example, between the electron-generation chamber 12 and the target chamber 14.

Figure 1:
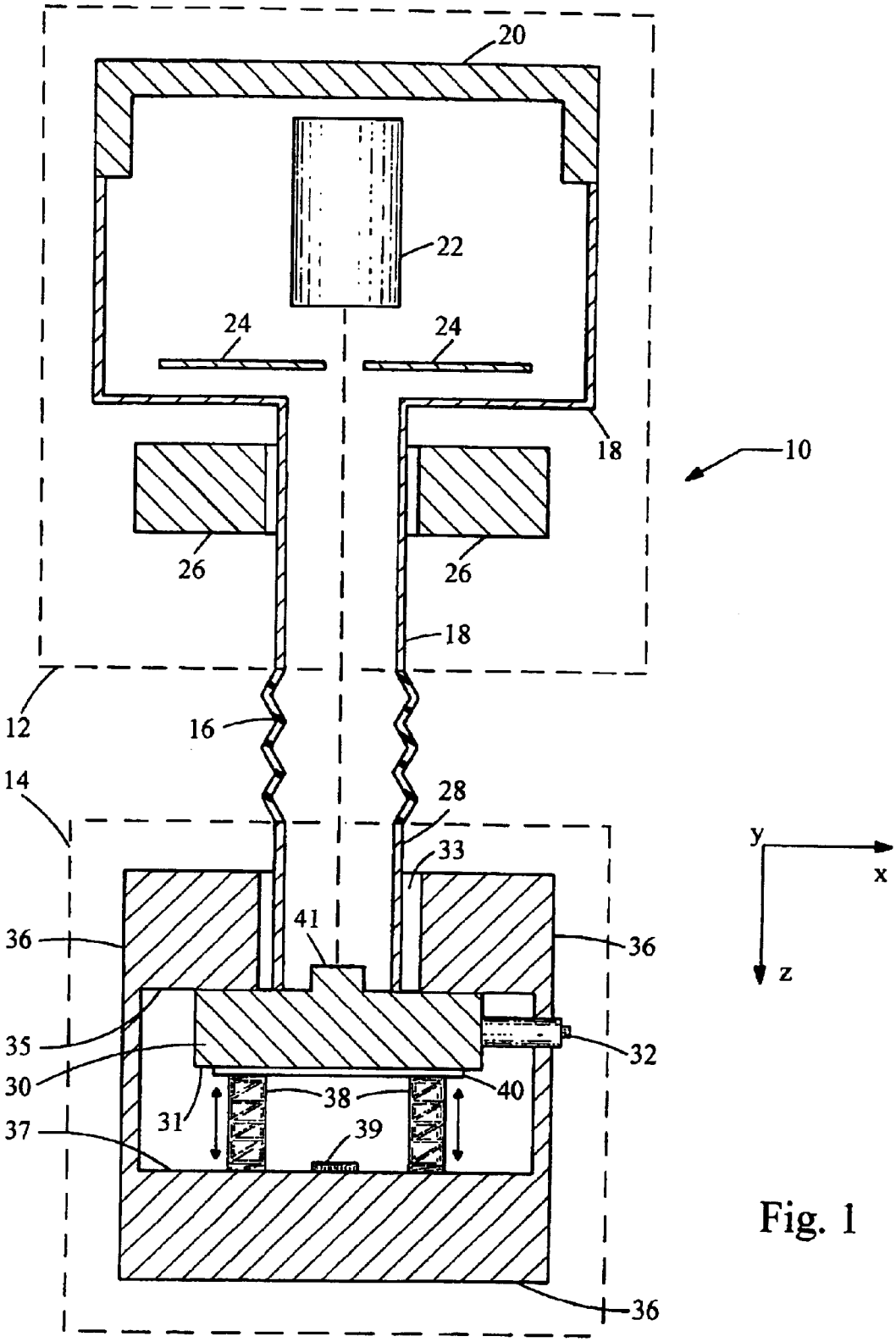
FIG. 1 is a longitudinal cross-sectional view of an x-ray source in accordance with the present invention.

Referring in particular to FIG. 1, the electron-generation chamber 12 and the target chamber 14 are connected by a flexible sealing member 16. The electron-generation chamber 12 is defined by a metal shell 18 and an insulator 20, such as glass or ceramic, that are vacuum sealable to prevent the introduction of air, dust or other contaminants that may be detrimental to the operation of the x-ray source 10. Electrons are generated in the electron-generation chamber 12 by an electron beam source 22 or cathode. The electrons are accelerated along the longitudinal axis before entering the aperture of the anode 24. Electron beam focusing can be realized either magnetically or electrostatically or in combination. For example, a magnet 26 produces a variable magnetic field such that it focuses the electron beam at or near the target surface 41.

The target chamber 14 generally includes a chute 28 about which a support structure 36 is positioned. The chute 28 defines an exit aperture 34 (FIG. 2) that permits the transmission of x-rays. The exit aperture 34 may be a window in the chute 28. The interior of the support structure 36 is partially defined by an upper surface 35 and a lower surface 37, and is further characterized in that it does not obscure the exit aperture 34. The upper surface 35 contains an opening 33 which receives the chute 28, thus permitting electrons generated by the electron beam source 22 to pass through towards the lower surface 37.

A target 30 with a target surface 41 is positioned within the support structure 36. An elastic member 38 is coupled to the lower surface 37 for exerting a sufficient pressure against the target 30 in order to keep the target 30 flush against the upper surface 35. In a preferred embodiment, the elastic member 38 is a spring of sufficient compression to exert the required force. In alternative embodiments, the elastic member 38 may be a series of springs for exerting the required force over a more uniform area.

The material of target surface 41 determines the x-ray radiation characteristics. The target 30 is typically made of copper since copper is a good heat conductor. The target surface 41 can be made of the same material as the body of the target or the surface material can be different.

To distribute the pressure exerted by the elastic member 38 on the target 30, a plate 40 may be inserted between the elastic member 38 and the target 30. In other embodiments, the plate 40 may be coupled to a series of elastic members 38, which may include a series of springs such as those described above.

The target 30 is further coupled to at least one target locator 32. Operation of the target locator 32 moves the target 30 a desired distance perpendicular to the longitudinal axis while the target is being bombarded with x-rays. In a preferred embodiment, the target locator 32 is affixed to the support structure 36 and uses mechanical means to displace the target 30. The target locator 32 may be accessible from the outside of the support structure 36 and may be an electromechanical device that operates in response to signals from a control unit, such as a personal computer. For example, the target locator may be a servo motor or any other suitable type of electromechanical motor. A cooling mechanism 39 may be introduced into the interior of the support structure 36 to remove heat from the target 30 produced by electron bombardments.

Figure 2:
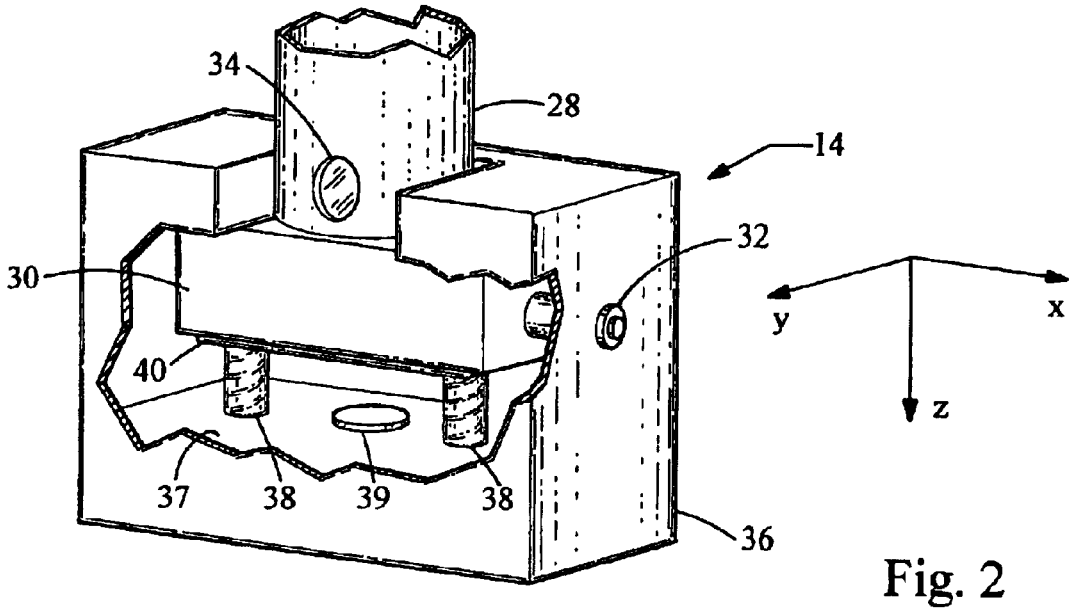
FIG. 2 is a partial cut-away perspective view of a portion of the x-ray source.

FIG. 2 depicts a partial cut-away view of the target chamber 14, illustrating in particular detail the coupling between the chute 28 and the support structure 36. Of particular note is that the support structure 36 is shaped in such a manner to permit the transmission of x-rays through the exit aperture 34, as discussed above.

Figure 3:
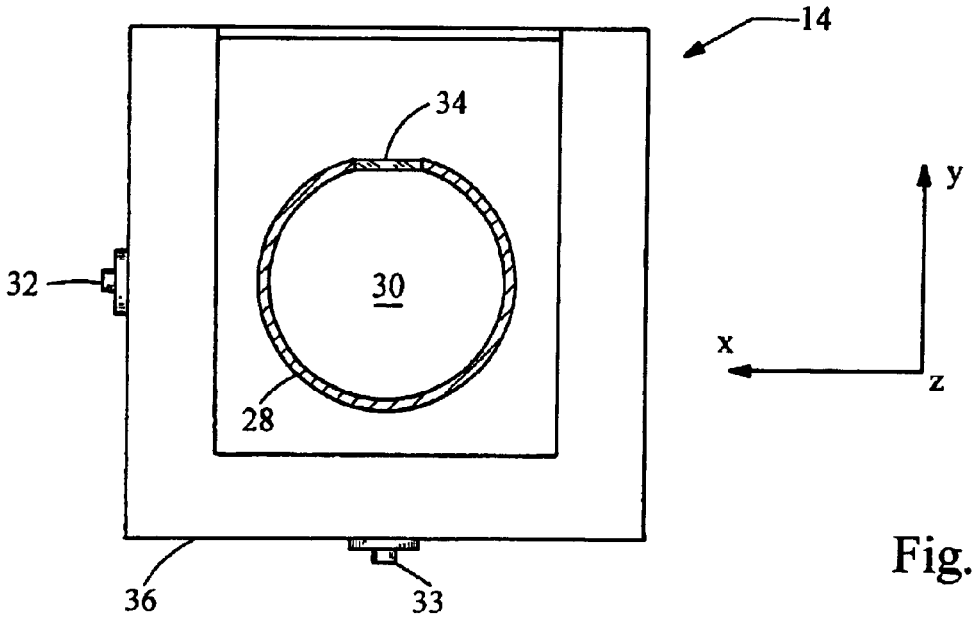
FIG. 3 is a cross-sectional view of a portion of the x-ray source along the longitudinal axis.

FIG. 3 is a cross-sectional view of the target chamber 14 along the longitudinal axis. As shown, the target locator 32 along with a second locator 33 are positioned in an orthogonal fashion about the support structure 36. Target locator 32 is adapted to displace the target 30 along the x-axis, and target locator 33 is adapted to displace the target 30 along the y-axis. Thus, operation of the locators 32 and 33 moves the target 30 in a coordinated manner in the x-y plane. The movement of the target 30 x-y plane maximizes the area subjected to electron bombardment. In the embodiment illustrated in FIGS. 1–3, the surface 35 is typically parallel to the target surface 41 to keep the x-ray source position from changing while the target locators 32 and 33 are use to move the target 30.

Referring again to FIG. 1, when the x-ray source 10 is in operation, the electron beam source 22 emits electrons that are accelerated before entering the aperture of the anode 24. After entering the aperture, the electrons travel without significant acceleration before interacting with the target electrons. The sudden deceleration of the electrons at the target 30 results in the emission of x-rays in all directions, and the portion of x-rays that pass through the exit aperture 34 is usable for, among other things, x-ray diffraction.

Repeated bombardment of the target 30 causes increased temperatures and material degradation of the target, and consequently decreased efficiency of the x-ray source 10. Ultimately, the target 30, or the entire x-ray source 10, may have to be replaced. To increase the life of the target 30, the target of the present invention is movable in a plane normal to the incidence of the electrons to change the region of the target 30 that is subject to bombardment, and hence enlarge the area of the target that is bombarded with electrons.

Figure 4:
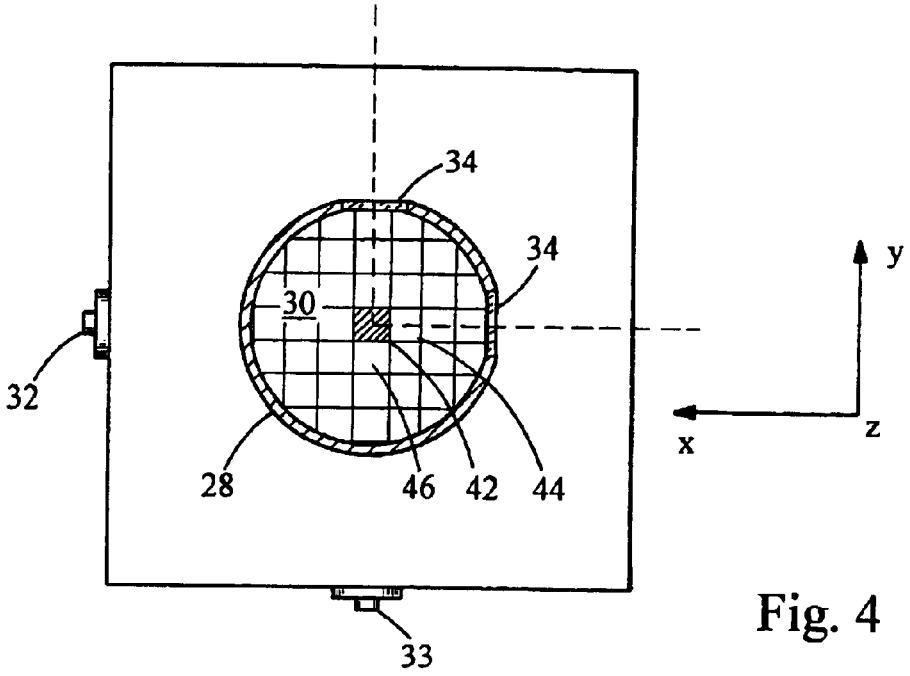
FIG. 4 is a schematic representation of a portion of the x-ray source of the depicting the motility of the target.

FIG. 4 is a schematic representation of the target 30 as viewed along the longitudinal axis. As previously shown, the area of the target 30 subject to bombardment is bounded by the chute 28, and the exit aperture 34 allows the transmission of a portion of the emitted x-rays. A selected area 42 of the target 30 is bombarded by electrons at any particular time. An operator can actuate the target locator 32 to shift the target 30 along the x-axis, thereby subjecting area 44 to bombardment. In a similar manner, the operator can actuate target locator 33 in order to shift the target 30 along the y-axis, thereby subjecting area 46 to bombardment. The target locators 32 and 33 can be operated sequentially or simultaneously. The target 30 can be moved while it is being bombarded with x-rays. Of course, the x-ray source can be turned off after a selected area has been bombarded with x-rays and then turned on again after the target has been moved to expose a new area to x-rays. In a preferred embodiment, each of the areas 42, 44, and 46 is less than about 0.05 $mm^2$ for a micro-focusing tube. Therefore, if the target 30 is movable over a range of about 1 $mm^2$, then the lifetime of the x-ray source 10 is increased substantially over prior designs in which the target remains stationary in an x-y plane.

Figure 5:
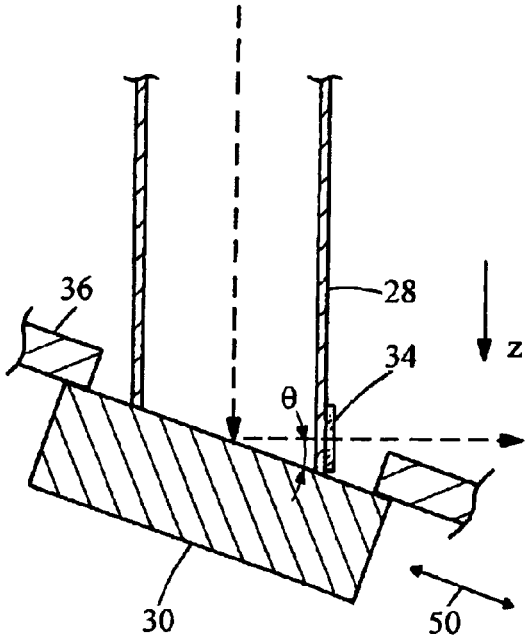
FIG. 5 depicts the target tilted at a desired angle.
Figure 6:
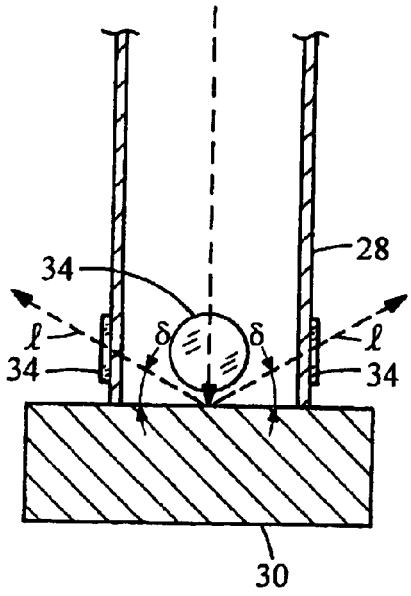
FIG. 6 depicts the target with apertures positioned above the target.

Referring now to FIG. 5, the target 30 can be tilted by an angle ($\theta$) of about, for example, 8° to provide for only one aperture 34. In such an implementation, the target 30 can be moved back and forth in the direction of the double arrow 50 as well as in and out of the page perpendicular to the double arrow 50. In other implementations, as shown in FIG. 6, one or more apertures 34 can be positioned above the target 30 so that a line of sight (I) through a respective aperture 34 and the top surface of the target 30 define an angle (δ) that may or may not be the same as the angle (θ) shown in FIG. 5. In some configurations, there are four or more apertures 34. In any multiple aperture configuration, the line of sight through one aperture is typically orthogonal to the line of sight through an adjacent aperture.

As described here, the x-ray source of the present invention provides efficient micro-focusing capabilities for moving the target to increase the effective target area subjected to electron bombardment, thereby increasing the durability of the target and hence the x-ray source. In particular, the target is preferably of a planar design and is movable independently in two directions perpendicular to the direction of the impinging electron beam.

Although the present invention has been described herein in terms of a preferred embodiment, it is understood that various modifications and adjustments to the preferred embodiment could be undertaken by one skilled in the art without departing from the scope of the present invention as set forth in the following claims.

What is claimed is:

1. An x-ray source comprising:

an electron-generation chamber including an electron beam source;

a target chamber including a support structure and a target positioned within the support structure, the emitted electrons traveling in a direction substantially parallel to a longitudinal axis extending between the electron-generation chamber and the target chamber towards the target and bombarding the target to generate x-rays, the target being movable, while being bombarded with electrons, with respect to the support structure in at least one direction substantially perpendicular to the longitudinal axis; and a flexible sealing member that couples the electron-generation chamber and the target chamber, the interior of the electron-generation chamber and the target chamber being sealed from ambient contaminants.

2. The x-ray source of claim 1 further comprising a target locator coupled to the target and adapted to move the target in the at least one direction perpendicular to the longitudinal axis.

3. The x-ray source of claim 2 further comprising a second target locator coupled to the target to move the target in at least a second direction substantially perpendicular to the longitudinal axis and orthogonal to the first direction.

4. The x-ray source of claim 1 further comprising a plate and an elastic member coupled to the plate, the elastic member and plate being positioned between the target and the support structure.

5. The x-ray source of claim 1 further comprising at least one exit aperture, a portion of the x-rays emitted from the target passing through the aperture.

6. The x-ray source of claim 1 wherein the target defines a planar surface substantially perpendicular to the longitudinal axis.

7. The x-ray source of claim 1 wherein the target defines a substantially planar surface tilted at an angle such the planar surface is non-orthogonal to the longitudinal axis.

8. The x-ray source of claim 7 further comprising a target locator coupled to the target and adapted to move the target in the at least first direction perpendicular to the longitudinal axis.

9. The x-ray source of claim 8 further comprising a second target locator coupled to the target to move the target in at least a second direction substantially parallel to the planar surface.

10. The x-ray source of claim 1 further comprising a focusing optic which focuses the electron beam, the focusing optic being selected from the group consisting of a magnetic focusing optic, an electrostatic focusing optic, or a combination of magnetic and electrostatic focusing optics.

11. An x-ray source comprising:

an electron-generation chamber including an electron beam source which emits electrons;

a target chamber including a target and a support structure, the support structure defining a lower surface and an upper surface, the target being movable within an interior region of the support structure in at least one direction perpendicular to a longitudinal axis extending between the electron-generation chamber and the target chamber, the emitted electrons traveling in a direction substantially parallel to the longitudinal axis towards the target and bombarding the target to generate x-rays;

a flexible sealing member mounted on the lower surface and coupling the electron-generation chamber and the target chamber; and at least one target locator coupled to the target and adapted to move the target in the at least one direction perpendicular to the longitudinal axis while the target is being bombarded with electrons.

12. The x-ray source of claim 11 further comprising a plate and an elastic member coupled to the plate, the elastic member and plate being positioned between the target and the support structure.

13. The x-ray source of claim 11 further comprising an exit aperture, a portion of the x-rays emitted from the target passing through the aperture.

14. The x-ray source of claim 11 wherein the target defines a substantially planar surface tilted at an angle such that the planar surface is non-orthogonal to the longitudinal axis.

15. The x-ray source of claim 14 further comprising a second target locator coupled to the target and adapted to move the target in a direction substantially parallel to the planar surface.

16. The x-ray source of claim 11 further comprising a focusing optic which focuses the electron beam, the focusing optic being selected from the group consisting of a magnetic focusing optic, an electrostatic focusing optic, or a combination of magnetic and electrostatic focusing optics.

* * * * *